US008574009B2

(12) United States Patent
Ho

(10) Patent No.: US 8,574,009 B2
(45) Date of Patent: Nov. 5, 2013

(54) COMPACT ELECTRICAL CONNECTOR

(75) Inventor: Yi-Tse Ho, Taipei Hsien (TW)

(73) Assignee: Molex Incorporated, Lisle, IL (US)

( * ) Notice: Subject to any disclaimer, the term of this patent is extended or adjusted under 35 U.S.C. 154(b) by 113 days.

(21) Appl. No.: 13/353,023

(22) Filed: Jan. 18, 2012

(65) Prior Publication Data

US 2012/0190243 A1 Jul. 26, 2012

(30) Foreign Application Priority Data

Jan. 18, 2011 (TW) ..... 100201095 U

(51) Int. Cl.
*H01R 24/28* (2011.01)

(52) U.S. Cl.
USPC ..... 439/629; 439/83

(58) Field of Classification Search
USPC ..... 439/629, 83, 74, 66, 660, 626
See application file for complete search history.

(56) References Cited

U.S. PATENT DOCUMENTS

| | | | | |
|---|---|---|---|---|
| 4,558,912 | A * | 12/1985 | Coller et al. | 439/246 |
| 5,207,598 | A * | 5/1993 | Yamada et al. | 439/636 |
| 7,726,979 | B2 * | 6/2010 | Lei et al. | 439/74 |
| 7,931,477 | B2 * | 4/2011 | Hirata et al. | 439/74 |
| 2002/0013075 | A1 * | 1/2002 | Kubo et al. | 439/101 |
| 2009/0197440 | A1 * | 8/2009 | Hirata et al. | 439/83 |
| 2009/0305528 | A1 * | 12/2009 | Hirata et al. | 439/74 |
| 2010/0330821 | A1 * | 12/2010 | Takeuchi et al. | 439/65 |

* cited by examiner

*Primary Examiner* — Briggitte R Hammond
(74) *Attorney, Agent, or Firm* — Stephen L. Sheldon

(57) ABSTRACT

An electrical connection device comprises a receptacle connector disposed on a side of a circuit board and a plurality of terminals. The receptacle connector comprises a housing, the housing having a body; an accommodating groove locating in the front of the body and opening upwards; a plurality of terminal grooves provided in the body, intervally arranged and in communication with the accommodating groove. The terminals are correspondingly disposed into the terminal grooves, respectively and each of the terminals can include a fixing portion uprightly secured in the first terminal groove; an U-shaped resilient arm folded forwards and then extending upwards from a lower end of the fixing portion; a contact portion formed at a distal end of the U-shaped resilient arm and extending into the accommodating groove; and a soldering portion extending upwards from an upper end of the fixing portion.

8 Claims, 6 Drawing Sheets

COMPACT ELECTRICAL CONNECTOR

RELATED APPLICATIONS

This application claims priority to Taiwan Application No. 100201095, filed Jan. 18, 2011, which is incorporated herein by reference in its entirety.

TECHNICAL FIELD

The present application relates to an electrical connection device, and more specifically, to an electrical connection device with a low profile.

BACKGROUND OF THE PRESENT APPLICATION

Referring to FIG. 1 and FIG. 2, Taiwan Utility model patent No. M391745 discloses a receptacle connector 500 which comprises a first housing 5 and a plurality of first terminals 6. The first housing 5 has a first body 51, an accommodating groove 52 locating in the front of the first body 51 and opening downwards, and a plurality of first terminal grooves 54 provided in the first body 51, intervally arranged, and in communication with the accommodating groove 52. Moreover, the first housing 5 further has a transversal wall portion 58 connected to a rear side of the first body 51, and a plurality of position-limiting grooves 59 respectively corresponding to the plurality of the first terminal grooves 54 are formed in the transversal wall portion 58. The plurality of the first terminals 6 are respectively disposed in the plurality of the first terminal grooves 54, respectively, and each of the first terminals 6 has a first fixing portion 61 uprightly secured in the first terminal groove 54, a resilient arm 62 folded forwards and then extending upwards from a lower end of the first fixing portion 61, a first contact portion 63 formed at a distal end of the first resilient arm 62 and extending into the accommodating groove 52, a first extending portion 64 foldedly extending rearwards from an upper end of the first fixing portion 61, and a first conductive connecting portion 65 foldedly extending downwards from a rear end of the first extending portion 64 and passing through the position-limiting groove 59 in the transversal wall portion 58. Because the first terminal 6 is folded in form of a general S-shape, the first terminal 6 not only has a profile thereof lowered but also has resiliency sufficient, and a whole profile of the receptacle connector 500 is also lowered.

However, because a strip is connected to the first conductive connecting portions 65 (i.e. soldering legs) of the first terminals 6, when the first terminals 6 are row inserted into the first terminal grooves 54 along a direction indicated as an arrow A, due to blocking from the transversal wall portion 58, the strip can not directly pass and has to pass around the transversal wall portion 58, which makes the first terminals 6 not easily assembled.

After the first terminals 6 are assembled to the first housing 5, because the first conductive connecting portion 65 of the first terminal 6 is too long, it is easy to make the first terminal 6 unstable and it is easy for the first terminal 6 to deviate from the first housing 5 along a direction indicated as an arrow B before soldering to a circuit board, consequently a problem on position alignment would be yielded and then secondary process would be performed for the position alignment. In addition, the conductive path from the first contact portion 63 to the first conductive connecting portion 65 of the first terminal 6 is relatively long and thus can decay of the transmitting signal. Consequentially, certain individuals would appreciate an improved electrical connector.

SUMMARY OF THE INVENTION

An electrical connection device comprises a receptacle connector which is disposed on a circuit board and comprises a first housing and a plurality of first terminals. The first housing has a first body; an accommodating groove locating in the front of the first body and opening upwards; a plurality of first terminal grooves provided in the rear of the first body, intervally arranged, and in communication with the accommodating groove, each of the first terminal grooves is concavely provided from up to down in the first body and the two adjacent first terminal grooves are spaced by a side wall; and a plurality of securing portions extending rearwards from the first body.

The first terminals are correspondingly disposed into the first terminal grooves from up to down, respectively. Each of the first terminal has: a first fixing portion uprightly secured in the first terminal groove; an U-shaped resilient arm folded forwards and then extending upwards from a lower end of the first fixing portion; a first contact portion formed at a distal end of the U-shaped resilient arm and extending into the accommodating groove and having a distal end as a free end; and a soldering portion extending upwards from an upper end of the first fixing portion and soldered to the circuit board from down to up.

In an embodiment, at least one of the securing portions extends rearwards with a supporting block from a rear end thereof. A convex post extends upwards from a top surface of the side wall, and the free end of each of the first terminals is located between the two adjacent convex posts, and the convex post has a top surface higher than a bottom surface of the circuit board. Each of the first terminal grooves can be concavely provided from up to down in the first body.

Preferably, a rear wall of the first body is located at the lower side of the circuit board, and the first body is provided with a plurality of retaining grooves opening upwards, and the electrical connection device further comprises a plurality of retaining tabs which correspondingly pass through the retaining grooves from down to up, respectively and are secured to the circuit board. Each of the first terminals can further comprise an extending portion foldedly extending rearwards from an upper end of the first fixing portion, and the soldering portion extends upwards from a distal end of the extending portion. And each of the first terminal grooves is defined by a rear wall and a pair of side walls together, the pair of side walls are concaved inwards at positions respectively adjacent the rear wall so that each of the first terminal grooves has an outward expanding portion extending toward the pair of side walls at a position adjacent the rear wall, the first fixing portion of each of the first terminals is positioned at the outward expanding portion, and a rear side of the first fixing portion abuts against the rear wall, the first resilient arm is located in the first terminal groove, the extending portion foldedly extends rearwards outside the first terminal groove to above the rear wall.

Preferably, the electrical connection device further comprises an interposer connector, which comprises a second housing and a plurality of second terminals, the second housing has a longitudinal mating portion engaging with the accommodating groove of the receptacle connector, each of the second terminals is disposed in the second housing and has an interposer portion with a flat-plate-like shape supported by the longitudinal mating portion, wherein the longitudinal mating portion is inserted into the accommodating groove from up to down so that the interposer portion with the flat-plate-like shape is electrically connected with the first contact portion of respective one of the first terminals extending into the accommodating groove.

DETAILED DESCRIPTION OF THE PREFERRED EMBODIMENTS

Figure 1:
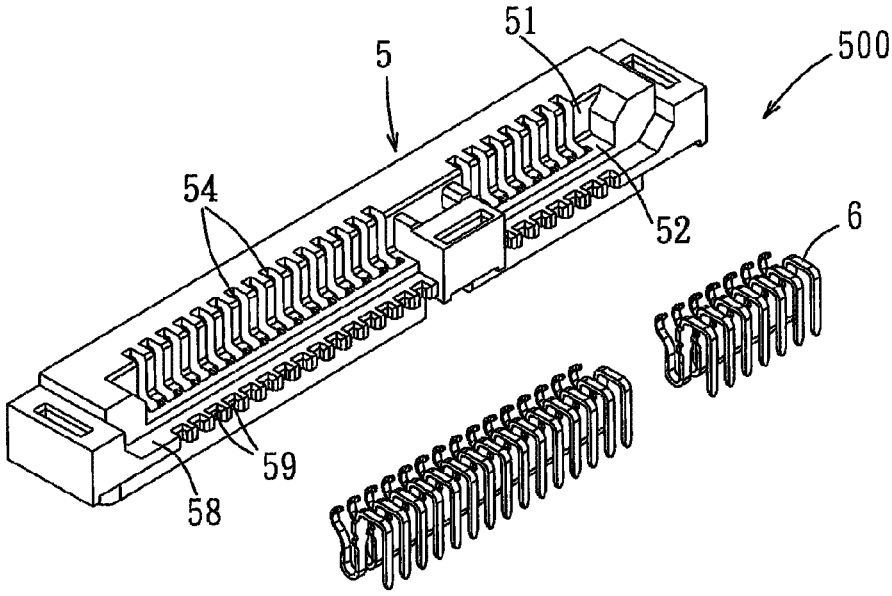
FIG. 1 is an exploded perspective view of a receptacle connector in prior art.
Figure 2:
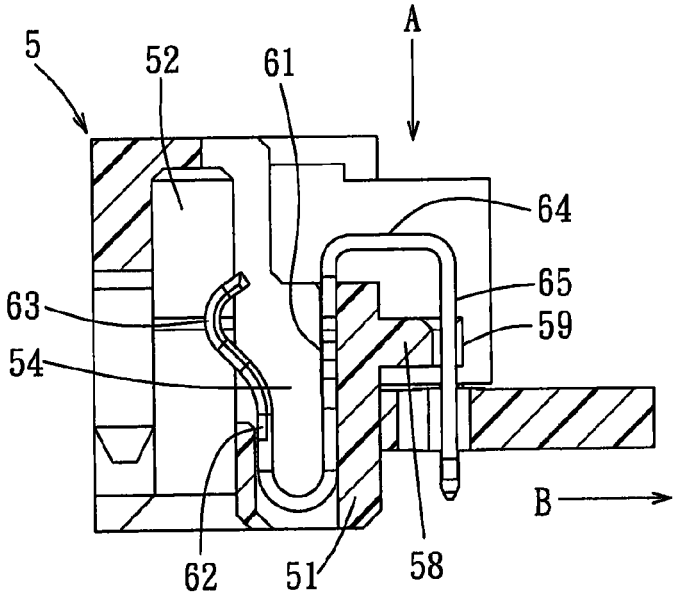
FIG. 2 is a sectional view of the receptacle connector of FIG. 1.

The foregoing and other technical contents, features and effects relating to the present application will be clearly shown through the following detailed description for a preferred embodiment in combination with the drawings. One benefit of the present application lies in that: it is easy to assemble the first terminals to the first housing, and the length of the soldering portion of each of the first terminals is short enough, each of the first terminals may be stably secured to the first housing; a conductive path from the first contact portion to the soldering portion of each of the first terminals is short, the transmitted signal may not easily be decayed; the convex post extending upwards from the side wall of the first housing may allow a length of the free end of the U-shaped resilient arm to extend into between the adjacent two convex posts, so that the U-shaped resilient arm is increased in length and has better resiliency; moreover, by that the supporting block extending rearwards behind the fixing portion abuts against under the circuit board, it may avoid the first housing from twisting upwards and consequently inclining. Therefore, a benefit of the present application is the ability to provide an electrical connection device wherein a receptacle connector thereof has a low profile that is easily assembled, and has a better stability and a shorter conductive path. Another benefit of the present application is to provide an electrical connection device wherein a receptacle connector thereof has a shorter conductive path and a better contact resiliency.

Referring to FIGS. 3-8, an electrical connection device according to a preferred embodiment of the present application comprises a receptacle connector 100 and an interposer connector 300 which are secured to a circuit board 83.

The receptacle connector 100 comprises a first housing 1, which can be formed of an insulative material, and a plurality of first terminals 2. The first housing 1 has a first body 11, an accommodating groove 12 locating in the front of the first body 11 and opening upwards, and a plurality of first terminal grooves 14 provided in the first body 11, intervally arranged, and in communication with the accommodating groove 12.

Figure 3:
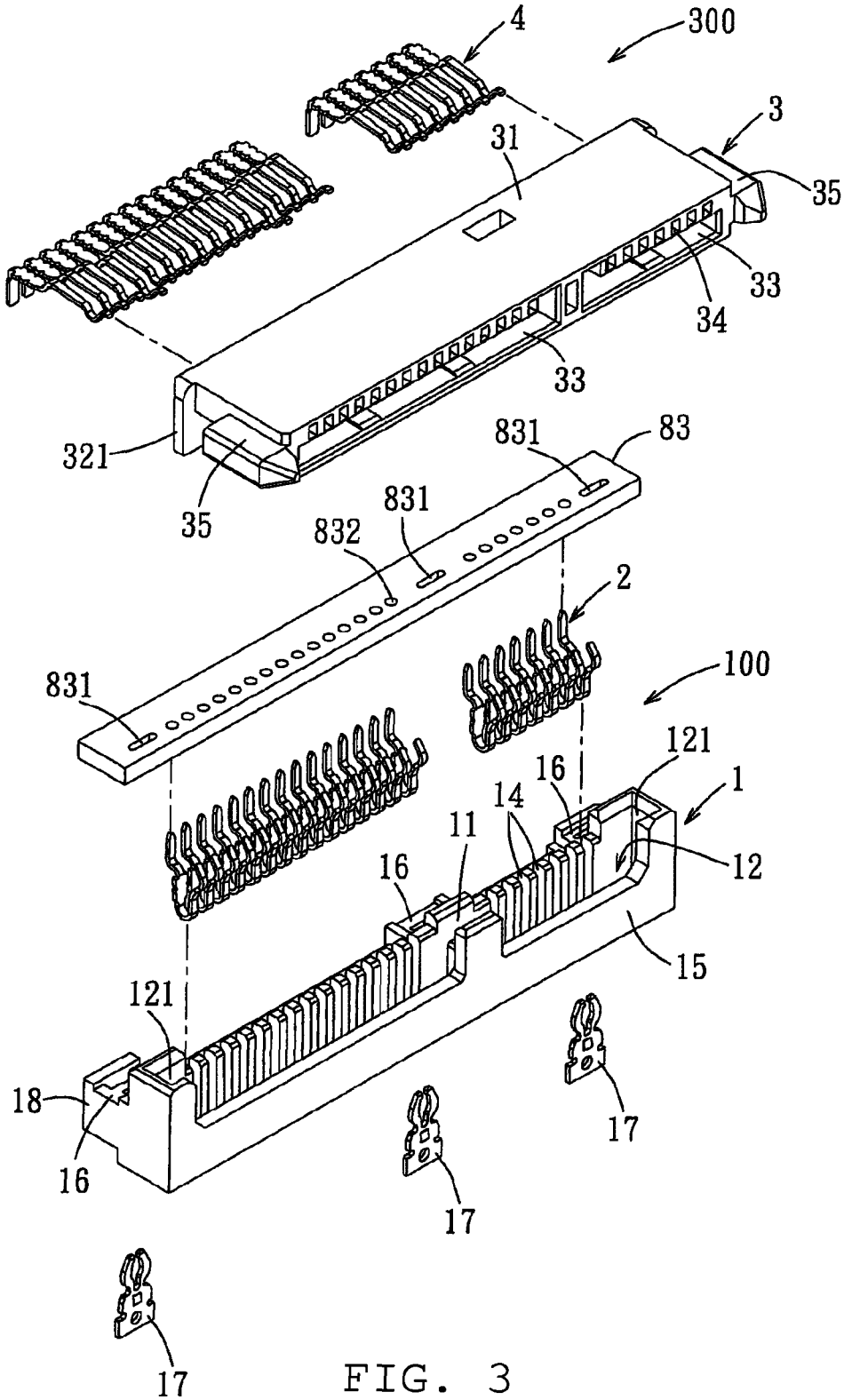
FIG. 3 is an exploded perspective view of an electrical connection device according to a preferred embodiment of the present application.
Figure 4:
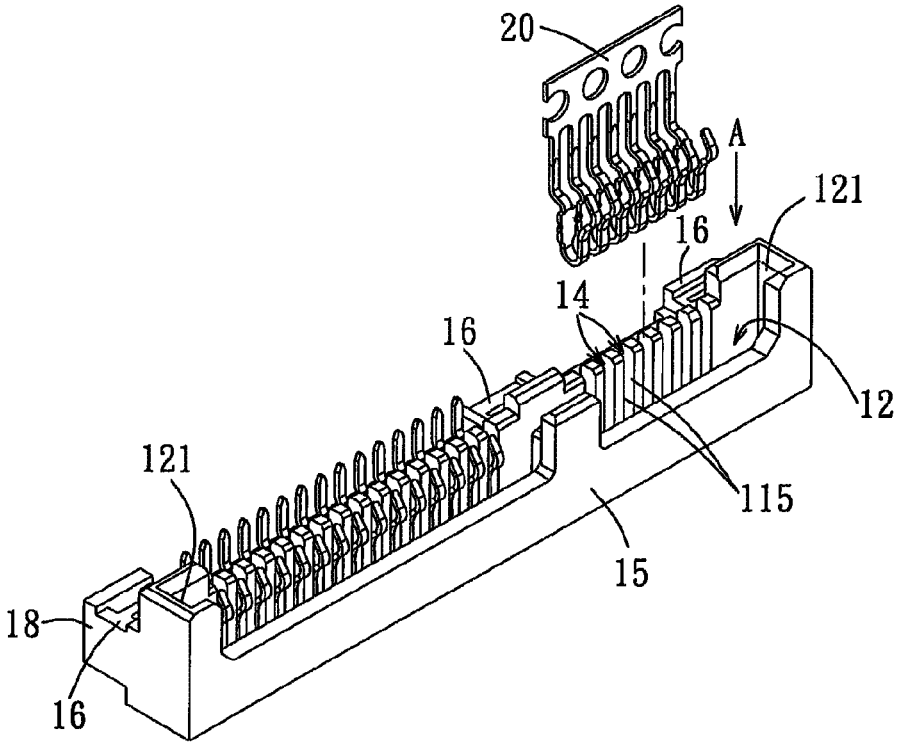
FIG. 4 is an exploded front perspective view of a receptacle connector to be assembled according to the present embodiment.
Figure 5:
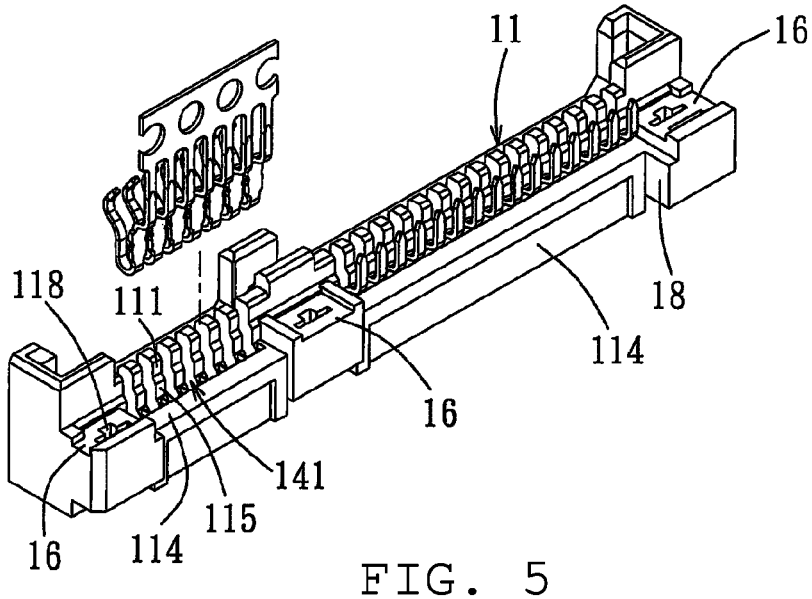
FIG. 5 is an exploded rear perspective view of the receptacle connector to be assembled according to the present embodiment.
Figure 8:
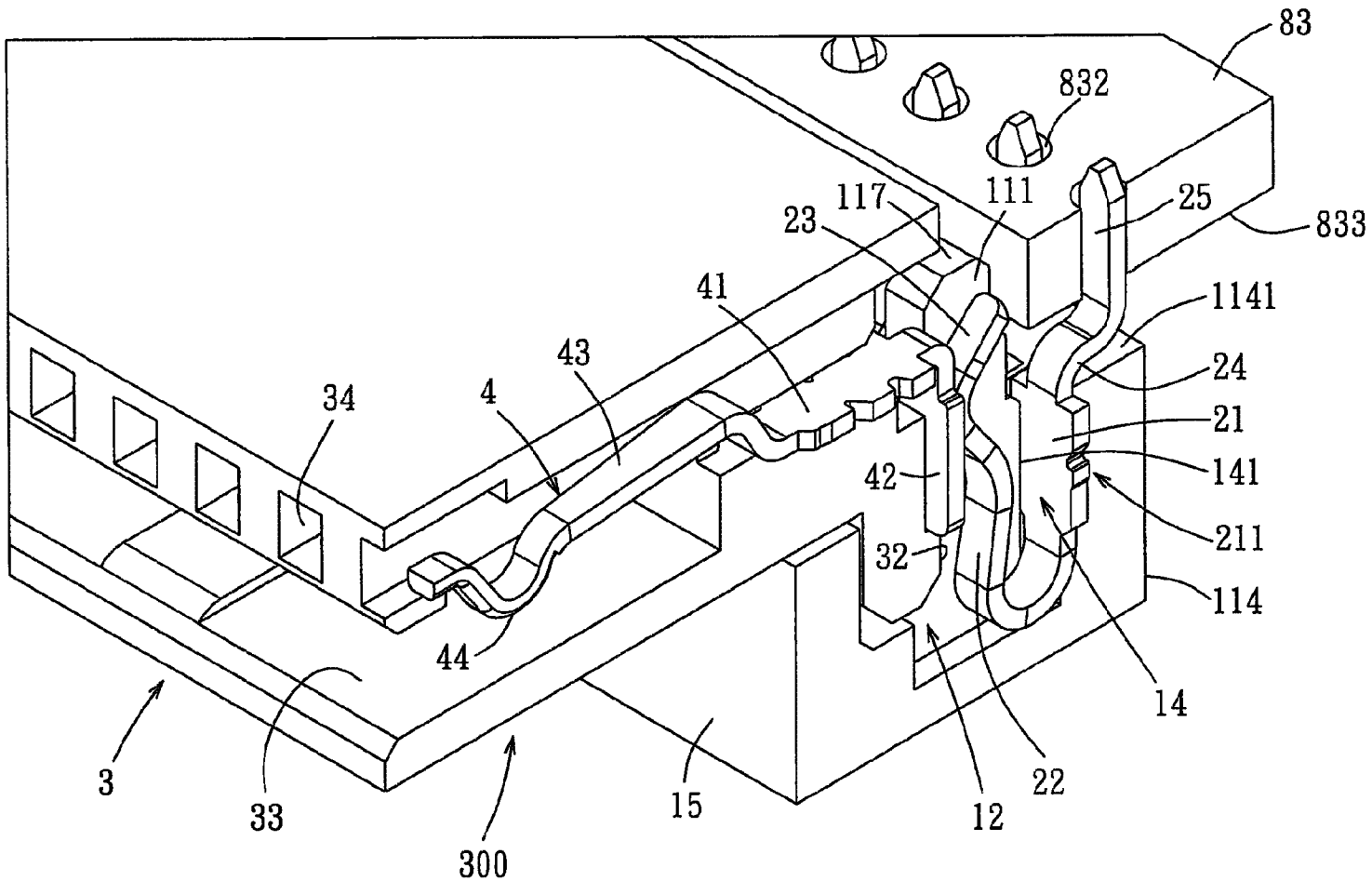
FIG. 8 is a partial sectional perspective view of the receptacle connector according to the present embodiment.

Referring to FIGS. 3-5, each of the first terminal grooves 14 is concavely provided from up to down in the first body 11 and defined by a rear wall 114 and a pair of side walls 115 together, the pair of side walls 115 are concaved inwards at positions respectively adjacent the rear wall 114 so that each of the first terminal grooves 14 has an outward expanding portion 141 extending toward the pair of side wall 115 at a position adjacent the rear wall 114. A convex post 111 extends upwards from a top surface of each of the side walls 115, and as shown in FIG. 8, the convex post 111 has a top surface 117 higher than a bottom surface 833 of the circuit board 83.

Moreover, the first housing 1 further has a front wall portion 15 connected to a front side of the first body 11, and the accommodating groove 12 is defined by the front wall portion 15 and the first body 11 together.

Figure 6:
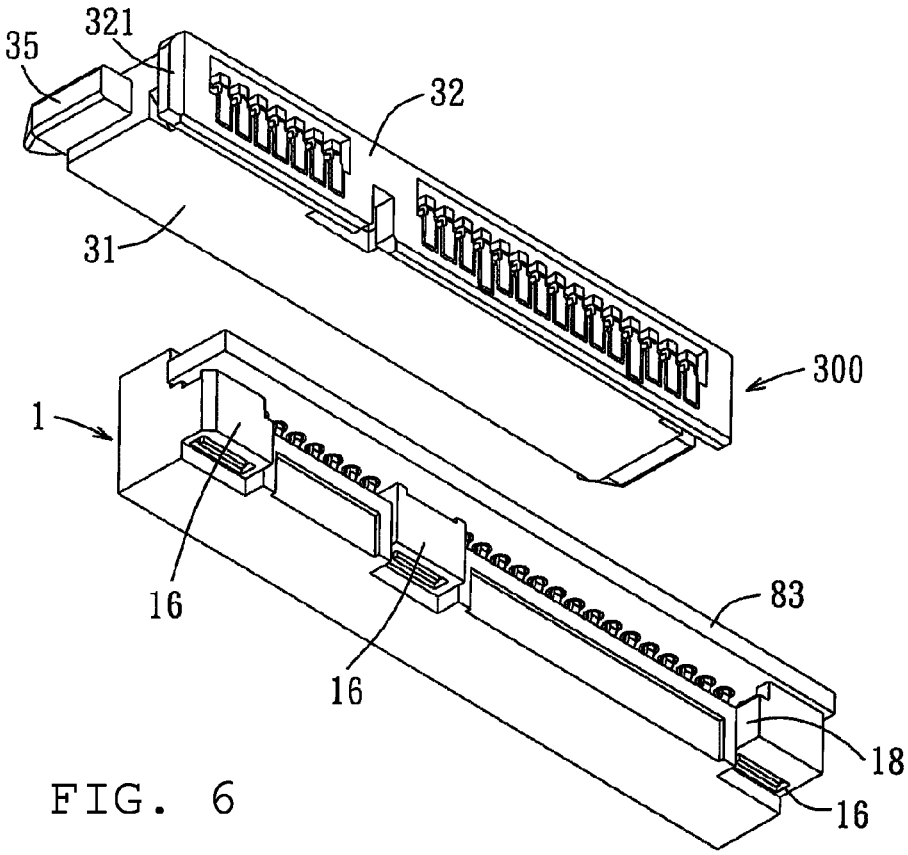
FIG. 6 is an exploded bottom perspective view of the receptacle connector and an interposer connector according to the present embodiment.

Referring to FIG. 5 and FIG. 6, the first housing 1 further has three securing portions 16 respectively provided in the first body 11. In the present embodiment, the three securing portions 16 are, for example but without limitation, provided at a right side, a left side, and a rear side of the rear wall 114. However, the number of the securing portions 16 may be two and are respectively provided at a right end and a left end of the first body 11. The securing portions 16 respectively correspond to fixing holes 831 in the circuit board 83, and as shown in FIG. 5, the rear wall 114 of the first body 11 is further provided with a plurality of retaining grooves 118 opening upwards. In the present embodiment, the retaining grooves 118 are correspondingly provided in the securing portions 16, respectively, and the first housing 1 is secured to the circuit board 83 by three retaining tabs 17 respectively passing through the respective retaining grooves 118 and the respective fixing holes 831 from down to up and engaged with the respective retaining grooves 118 and the respective fixing holes 831.

Figure 7:
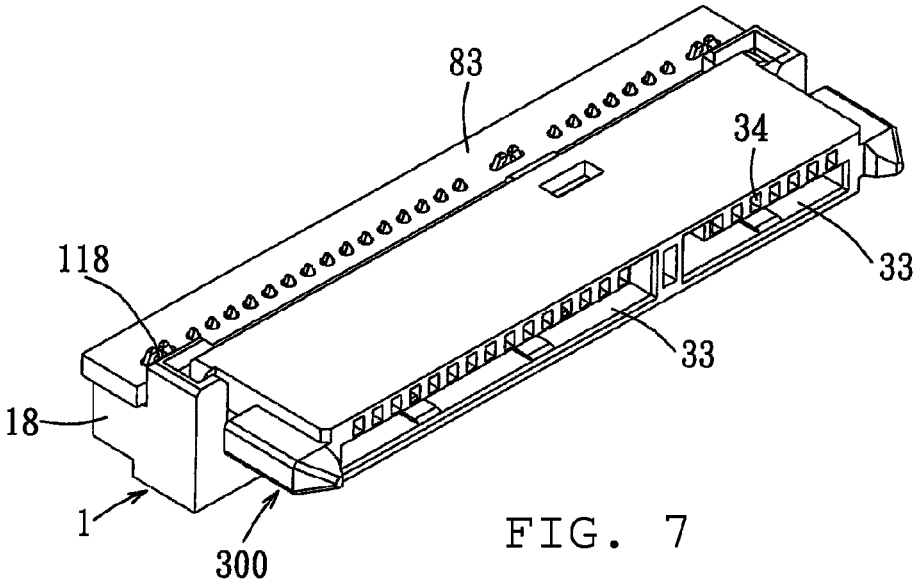
FIG. 7 is a perspective view of the receptacle connector and the interposer connector assembled together according to the present embodiment.

In addition, at least one of the securing portions 16 is extended with a supporting block 18 from a rear end thereof. In the present embodiment, the supporting block 18 is provided behind the securing portion 16 close to a side of the rear wall 114. And as shown in FIG. 6, a top surface 161 of the supporting block 18 is contacted with the bottom surface of the circuit board 83, and an overlapped area between the supporting block 18 and the circuit board 83 is larger than that between the securing portion 16 and the circuit board 83. With this configuration, as shown in FIG. 7, when the interposer connector 300 is inserted downwards into the housing 1 of the receptacle connector 100, the first housing 1 would be twisted upwards around the retaining grooves 118 as fulcrums, at this time because the circuit board 83 abuts downwards against and presses the supporting block 18 of the housing 1 so that the housing 1 is not easily twisted upwards, and in turn the stability effect is attained, thereby avoiding the housing 1 from inclination due to twisting force.

Referring to FIG. 3, FIG. 4 and FIG. 8, the second terminals 2 are correspondingly disposed into the first terminal grooves 14 from up to down, respectively. Each of the first terminal 2 has a first fixing portion 21 uprightly secured in the first terminal groove 14, an U-shaped resilient arm 22 folded forwards and then extending upwards from a lower end of the first fixing portion 21, a first contact portion 23 formed at a distal end of the U-shaped resilient arm 22 and extending into the accommodating groove 12, an extending portion 24 foldedly extending rearwards from an upper end of the first fixing portion 21, and a soldering portion 25 foldedly extending upwards from a rear end of the extending portion 24. A distal end of the contact portion 23 is a free end, and the soldering portions 25 correspondingly pass through preset through holes 832, respectively, and are secured to the circuit board 83 by respectively soldering to the through holes 832, so that an electrical connection is established between the soldering portion 25 and the circuit board 83. And as shown in FIG. 8, after the first terminal 2 is assembled to the first housing 1, the soldering portion 25 of the first terminal 2 has a sufficient short length, so that the first terminal 2 may be stably secured on the first housing 1 and consequently may not easily deviate from the first housing 1.

The first fixing portion 21 of the first terminal 2 is positioned at the outward expanding portion 141 of the first terminal groove 14, and a rear side of the first fixing portion 14 abuts against the rear wall 114, two sides of the first fixing portion 21 are formed with fixing structures 211 respectively interferingly engaging with the two side walls 115. The U-shaped resilient arm 22 is located at a side opposite to the first fixing portion 21, and because the U-shaped resilient arm 22 is folded forwards from the lower end of the first fixing portion 21, so the a length of the U-shaped resilient arm 22 may be increased and thus the U-shaped resilient arm 22 has sufficient resiliency.

And the convex post 11 extending upwards from the side wall 115 allows that the free end of the U-shaped resilient arm 22 may extend into between the two adjacent convex posts 111, so that the U-shaped resilient arm 22 may further be increased in the length thereof and has better resiliency, thereby an effect, that a conductive path from the first contact portion 23 to the soldering portion 25 is shorter but the first contact portion 23 has better contact resiliency, may be attained.

The height of the top surface 117 of each of the convex posts 111 is higher than the height of the first contact portion 23 of each of the first terminals 2, which may assure the first contact portion 23 is not pressed by undue external force or accidentally contacts other conductive elements.

Referring to FIG. 3, FIG. 6, and FIG. 8, the interposer connector 300 comprises a second housing 3 and a plurality of second terminals 4. The second housing 3 has a second body 31, a longitudinal mating portion 32 engaging with the accommodating groove 12 of the receptacle connector 100, and a transversal insertion slot 33 (dividing into two parts, i.e., a left part and a right part). The longitudinal mating portion 32 is uprightly connected to a long side edge of the second body 31, and the longitudinal mating portion 32 extends respectively toward a left side and a right side with respect to the second body 31, so as to form two side flanges 321. The two side flanges 321 may engage with guiding rails 121 respectively formed at two sides, i.e. a left side and a right side, of the front wall portion 15 defining the accommodating groove 12 in the first housing 1, so as to together form a guide structure when the interposer connector 300 is mated with the receptacle connector 100, thereby the longitudinal mating portion 32 easily enter into the accommodating groove 12 from up to down. The transversal insertion slot 33 is located in the second body 31 and has an inlet for mating another connector (not shown) locating a side opposite to a side that the second body 31 is connected to the longitudinal mating portion 32.

Each of the second terminals 4 is disposed in the second housing 3, and the second housing 3 further has a plurality of second terminal grooves 34 respectively correspondingly accommodating the second terminals 4. Each of the second terminals 4 has a second fixing portion 41, an interposer portion 42 with a flat-plate-like shape, a resilient arm 43, and a second contact portion 4. The second fixing portion 41 is secured to the second housing 3, the interposer portion 42 foldedly extends downwards from an end of the second fixing portion 41 and is supported by the longitudinal mating portion 32 (referring to FIG. 8), the second resilient arm 43 extends toward the transversal insertion slot 33 from the other end of the second fixing portion 41, and the second contact portion 44 is formed at a distal end of the resilient arm 43 and extends into the transversal insertion slot 33.

Moreover, the second housing 3 further has two guiding-positioning portions 35 respectively provided at two short sides of the second body 31 which may guide the interposer connector 300 to be easily aligned and mated with another connector to be connected.

Figure 9:
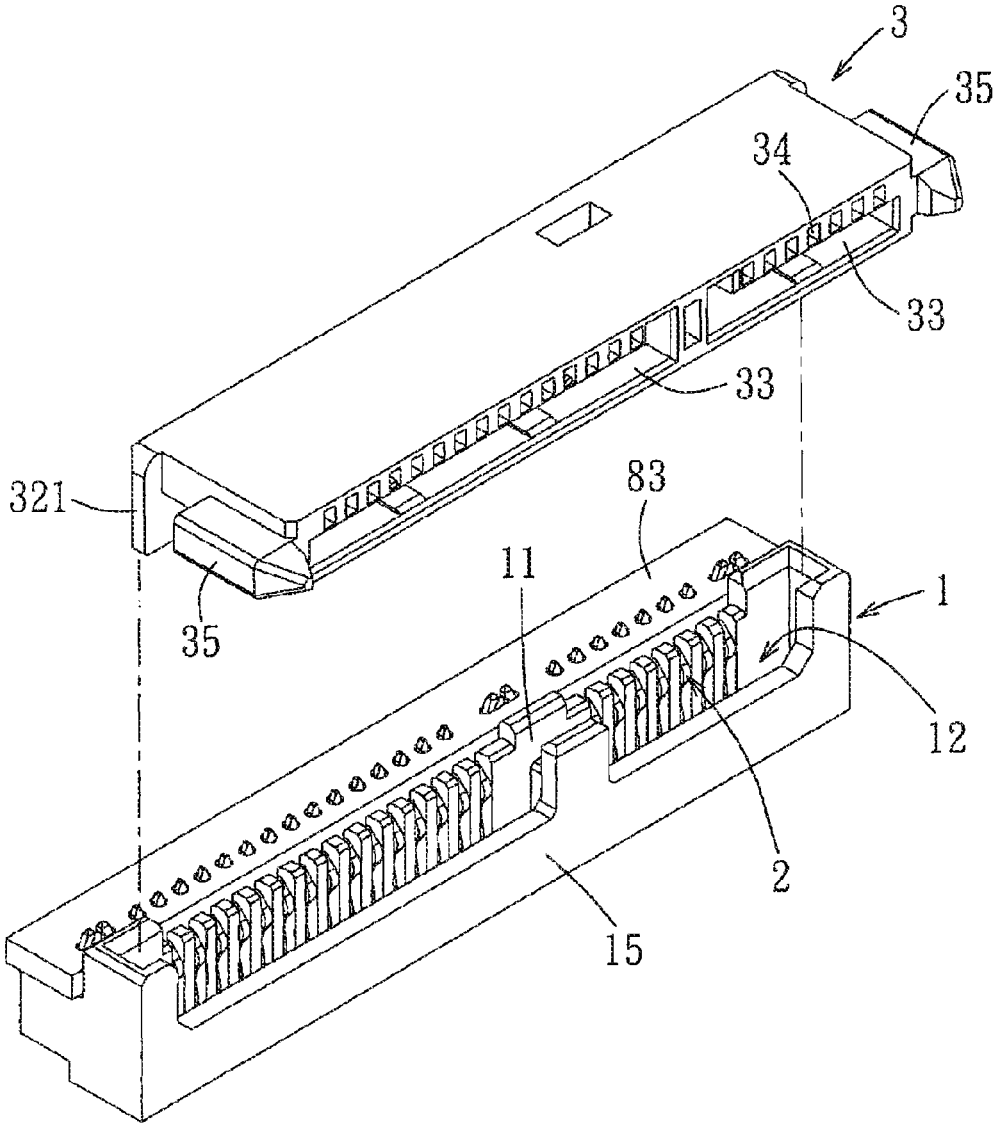
FIG. 9 is an exploded top perspective view of the receptacle connector and the interposer connector according to the present embodiment.

Referring to FIG. 8 and FIG. 9, the longitudinal mating portion 32 of the interposer connector 300 is longitudinally mated with the accommodating groove 12 of the receptacle connector 100 and the longitudinal mating portion 32 of the interposer connector 300 is inserted into the accommodating groove 12 of the receptacle connector 100 from up to down, so that the interposer portion 42 of each of the second terminals 4 (referring to FIG. 8) is contacted with the first contact portion 23 of respective one of the first terminals 2 so as to establish an electrical connection. Referring to FIG. 7 and FIG. 8, when the interposer connector 300 is mated with the receptacle connector 100 together, because the interposer connector 300 is overlapped with the receptacle connector 100 in profile, the whole profile of the electrical connection device is lowered, consequently, it may be applied in a thin-type electronic device, such as notebook computer, and in turn a thickness of the thin-type electronic device may be reduced to meet the thin-type requirements.

In addition, in addition to low profile, the receptacle connector 100 can also provide additional advantages. As shown in FIG. 4, when the first terminals 2 connected together via the strip 20 are row inserted into the first terminal grooves 14, the strip 20 will not be intervened with the first terminal grooves 14, so that it is easy to assemble the first terminals 2 to the first housing 1. As shown in FIG. 8, after the first terminals 2 are assembled to the first housing 1, because the length of the soldering portion 25 of each of the first terminals 2 is short enough, each of the first terminals 2 may be stably secured to the first housing 1 and may not easily deviate from the first housing 1. In addition, because a conductive path from the first contact portion 23 to the soldering portion 25 of each of the first terminals 2 is short, the transmitted signal may not easily be decayed. In addition, the convex post 111 extending upwards from the side wall 115 of the first housing 1 may allow a length of the free end of the U-shaped resilient arm 22 to extend into between the adjacent two convex posts 111, so that the U-shaped resilient arm 22 is increased in length and has better resiliency, and thereby an effect, that the conductive path from the first contact portion 23 to the soldering portion 25 of each of the first terminals 2 is shorter but the first contact portion 23 has better contact resiliency, may be attained. Furthermore, if the supporting block 18 extends rearwards behind the securing portion 16 that abuts against under the circuit board 83, then it may avoid the first housing 1 from twisting upwards and consequently inclining.

It should be noted that the present application illustrates the receptacle connector 100 disposed at a lower side of the circuit board 83, however, it can be understood that, as an arrangement direction of the receptacle connector 100 is changed, the positional relationship among the above components may be also changed. For example, when the receptacle connector 100 is flipped 180 degree and then disposed on an upper side of the circuit board 83, the up-down positional relationship among the above components may be modified accordingly. Similarly, when the circuit board 83 is disposed vertically, the receptacle connector 100 may disposed on a left side or a right side of the circuit board 83, the up-down positional relationship between the above components would be changed to a left-right positional relationship.

What have been described above are only preferred embodiments of the present application, but it is definitely not able to limit a scope for implementing the present application, that is to say, all the simple equivalent changes and modifications devised according to the scope and the contents of the present application will be still fallen within the scope of the present application. Therefore numerous other embodiments, modifications and variations within the scope and spirit of the appended claims will occur to persons of ordinary skill in the art from a review of this disclosure.

What is claimed is:

1. An electrical connection device comprising a receptacle connector, the receptacle connector being disposed at a lower side of a circuit board and comprising:

a first housing having:

a first body;

an accommodating groove locating in the front of the first body and opening upwards;

a plurality of first terminal grooves provided in the rear of the first body, intervally arranged, and in communication with the accommodating groove, each of the first terminal grooves being concavely provided from up to down in the first body and the two adjacent first terminals being spaced by a side wall; and a plurality of securing portions extending rearwards from the first body; and a plurality of first terminals correspondingly disposed into the first terminal grooves from up to down, respectively, each of the first terminal has:

a first fixing portion uprightly secured in the first terminal groove;

an U-shaped resilient arm folded forwards and then extending upwards from a lower end of the first fixing portion;

a first contact portion formed at a distal end of the U-shaped resilient arm and extending into the accommodating groove and having a distal end as a free end; and a soldering portion extending upwards from an upper end of the first fixing portion and soldered to the circuit board from down to up.

2. The electrical connection device according to claim 1, wherein at least one of the securing portions is extended rearwards with a supporting block from a rear end thereof.

3. The electrical connection device according to claim 2, wherein a convex post extends upwards from a top surface of each of the side walls, and the free end of each of the first terminals is located between the two adjacent convex posts.

4. The electrical connection device according to claim 3, wherein the convex post has a top surface higher than a bottom surface of the circuit board.

5. The electrical connection device according to claim 4, wherein each of the first terminals further has an extending portion foldedly extending rearwards from an upper end of the first fixing portion, and the soldering portion extends upwards from a distal end of the extending portion.

6. The electrical connection device according to claim 5, wherein the rear wall of the first body is located under the lower side of the circuit board, and the first body is provided with a plurality of retaining grooves opening upwards, the retaining grooves are correspondingly provided in the securing portions, respectively, and the electrical connection device further comprises a plurality of retaining tabs which correspondingly pass through the retaining grooves from down to up, respectively, and are secured to the circuit board.

7. The electrical connection device according to claim 6, wherein each of the first terminal grooves is defined by a rear wall and a pair of side walls together, the pair of side walls are concaved inwards at positions respectively adjacent the rear wall so that each of the first terminal grooves has an outward expanding portion extending toward the pair of side walls at a position adjacent the rear wall, the first fixing portion of each of the first terminals is positioned at the outward expanding portion, and a rear side of the first fixing portion abuts against the rear wall, the first resilient arm is located in the first terminal groove, the extending portion foldedly extends rearwards outside the first terminal groove to above the rear wall.

8. The electrical connection device according to claim 4, further comprising an interposer connector, the interposer connector comprises a second housing and a plurality of second terminals, the second housing has a longitudinal mating portion engaging with the accommodating groove of the receptacle connector, each of the second terminals is disposed in the second housing and has an interposer portion with a plate-like shape supported by the longitudinal mating portion, wherein the longitudinal mating portion is inserted into the accommodating groove from up to down so that the interposer portion with the plate-like shape is electrically connected with the first contact portion of respective one of the first terminals extending into the accommodating groove.

* * * * *